United States Patent [19]

Silsby et al.

[11] 3,977,296

[45] Aug. 31, 1976

[54] HYDRAULIC BUFFER ASSEMBLY FOR AUTOMATIC OR SEMIAUTOMATIC FIREARM

[75] Inventors: Stanley D. Silsby, Granby; Henry J. Tatro, Westfield, both of Mass.

[73] Assignee: Colt Industries Operating Corporation (Firearms Division), Hartford, Conn.

[22] Filed: Dec. 4, 1974

[21] Appl. No.: 529,394

[52] U.S. Cl. ..... 89/198

[51] Int. Cl.[2] ..... F41D 11/12

[58] Field of Search ..... 89/198

[56] References Cited

UNITED STATES PATENTS

| | | | |
|---|---|---|---|
| 1,351,141 | 8/1920 | Thompson | 89/198 |
| 2,973,694 | 3/1961 | Herlach et al. | 89/198 |
| 3,366,011 | 1/1968 | Sturtevant | 89/198 |

*Primary Examiner*—Stephen C. Bentley

[57] ABSTRACT

A recoil assembly for an automatic firearm, including a reciprocating bolt and carrier assembly, has a hydraulic buffer to provide a reduced rate of fire and prevent wide fluctuation in the round to round rate of fire. The buffer includes a piston which pushes hydraulic fluid through an orifice when depressed by the bolt and carrier assembly at the end of its recoil stroke. When the bolt and carrier assembly begins to displace the piston, hydraulic retardation is immediate. A spring loaded sliding seal pushes the hydraulic fluid through the orifice during the return stroke which returns the piston to its original extended position. The buffer also prevents carrier bounce and promotes a mild recoil shock.

3 Claims, 4 Drawing Figures

HYDRAULIC BUFFER ASSEMBLY FOR AUTOMATIC OR SEMIAUTOMATIC FIREARM

BACKGROUND OF THE INVENTION

This invention relates to semiautomatic and automatic firearms and more particularly to buffers therefor. The invention also relates to automatic firearms which incorporate a means to reduce the rate of fire during automatic operation.

It has been found that in most automatic firearms, it is necessary to cushion the load imparted to the frame of the firearm by the sudden stoppage of movement of the bolt and carrier assembly at the termination of recoil. This is usually accomplished by providing a resilient buffer at the rear of the bolt and carrier assembly or at the end of the receiver. Various forms of buffers are known in the art. For example, the buffer may travel with the bolt and carrier assembly or be fixedly mounted in the receiver. An example of the former is shown in U.S. Pat. No. 3,366,011. The buffer of this patent is in current use in the M-16 rifle and serves a dual function in that it not only cushions the impact at the termination of recoil, but also prevents rebound or bounce of the bolt carrier of the bolt and carrier assembly after it slams into the breech end of the barrel. As discussed in detail in the patent, such rebound can prevent adequate firing pin protrusion from the bolt face.

Hydraulic buffers which serve to reduce the rate of fire of automatic weapons are known in the art. One such buffer includes a directly spring loaded piston which must first compress its spring before encountering hydraulic resistance from the fluid which fills only a portion of the piston's chamber, the remaining portion being occupied by air. A disadvantage of this buffer is that it does not provide immediate hydraulic retardation and that the air therein is heated by compression, in addition to causing foaming of the hydraulic fluid.

SUMMARY OF THE INVENTION

A recoil assembly of the invention not only cushions and prevents carrier rebound, but also functions to substantially reduce the rate of automatic fire, as the following will make evident.

A recoil assembly of the invention includes a buffer having a tubular housing sealed at the rear end by a bumper adapted to engage the end of a receiver extension and by a piston at the front end adapted to engage a reciprocating bolt and carrier assembly. A spring, seated upon the bumper, urges a sliding seal in a forward direction. The volume between the seal and the piston is filled with hydraulic fluid and contains an orifice, fixedly mounted in the housing for furnishing hydraulic resistance to movement of the piston.

In accordance with the invention, the buffer travels with the end of an operating spring which is seated against a flange thereof. At the end of the recoil stroke, the momentum of the bolt and carrier assembly causes depression of the piston from its original extended position, thereby increasing the time interval of the recoil stroke. During the return stroke, the spring-loaded seal within the buffer pushes fluid through the orifice in the opposite direction, thereby to return the piston to its original position. Since a buffer of the invention has its interior volume between the seal and the piston filled with fluid, hydraulic resistance commences as soon as the piston is displaced.

It has been found that a buffer of the invention is not only advantageous with respect to a reduction in the rate of automatic fire, but additionally furnishes a more consistent rate of fire between rounds in automatic operation. This is attributable to the cushioning action of the hydraulic fluid which is forced through the orifice and displaces the sliding seal. This action substantially dissipates the remaining kenetic energy in the opening components of the bolt and carrier assembly. Consequently, the only energy available to return the bolt and carrier assembly to the battery position is that energy stored in the compressed operating spring, there being no bouncing forward from the end of the receiver extension. Since only the operating spring tends to return the bolt and carrier assembly from the recoil position to the battery position, a more uniform return velocity is occasioned; and hence, the round to round rate of fire exhibits less variation. Also, since a buffer of the invention more efficiently dissipates excess recoil energy and thereby minimizes shock due to recoil, it is useful in semiautomatic firearms as well.

Accordingly, it is a primary object of the invention to provide a recoil assembly for an automatic firearm which reduces the rate of fire thereof during automatic operation.

Another object is to provide a buffer for an automatic firearm which engenders a more consistent rate of fire during automatic operation.

Yet another object is to provide a buffer which prevents bolt carrier bounce.

A further object is to provide a buffer for an automatic firearm which furnishes immediate hydraulic retardation of the bolt and carrier assembly when the buffer first contacts the receiver extension.

A still further object is to provide a buffer for an automatic or semiautomatic firearm which minimizes recoil shock.

These and other objects and advantages of the invention will become more readily apparent from the following detailed description, when taken in conjunction with the accompanying drawings, in which.

DETAILED DESCRIPTION OF PREFERRED EMBODIMENT

Figure 1:
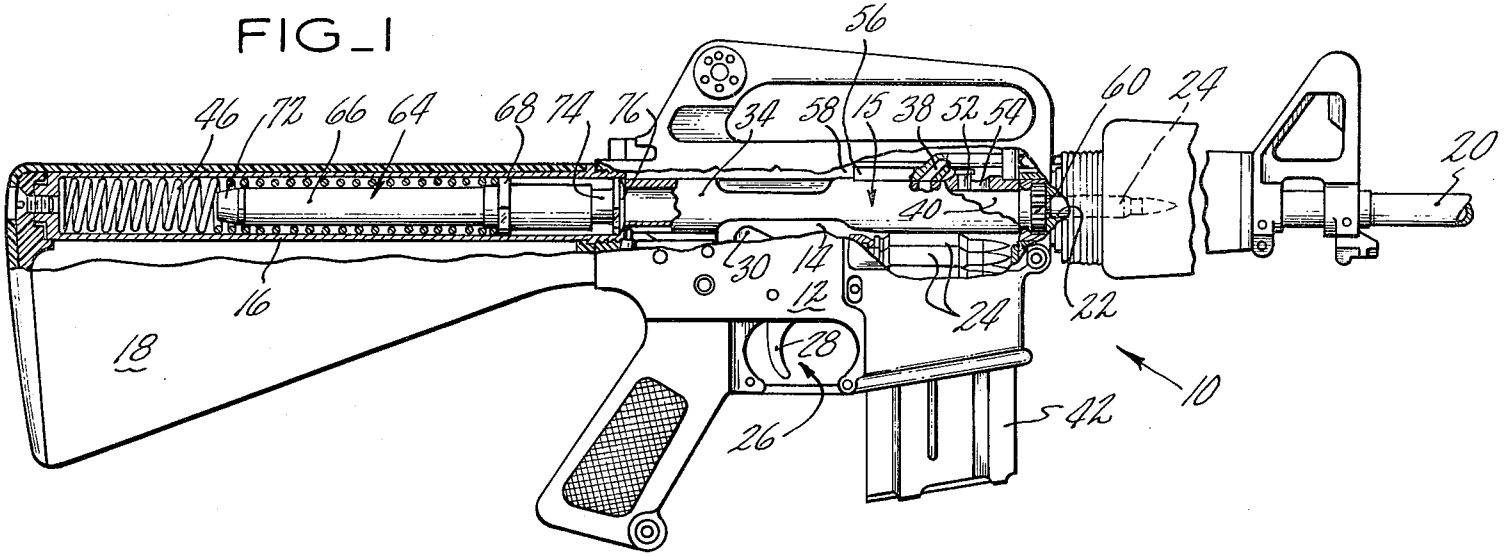
FIG. 1 is a fragmentary side elevational view, partially broken away and partially in section of an automatic firearm incorporating a recoil assembly of the invention, with the components thereof in the battery position.

Referring to the drawings, and more particularly to FIG. 1, there is shown a gas operated firearm 10. A receiver 12 has a chamber 14 for receiving a bolt and carrier assembly 15. The rear portion of chamber 14 is defined by a receiver extension 16 located in the stock 18. Connected to the forward portion of the chamber 14 is a barrel 20 having a cartridge chamber 22 in which a cartridge 24 may be positioned.

The trigger mechanism, generally shown at 26, is similar to the mechanism described in U.S. Pat. No.

3,236,155, issued Feb. 22, 1966 and is not described in detail herein since it forms no part of the present invention. Suffice it to say, for the purposes of this invention, that upon pulling a trigger 28 of trigger mechanism 26, a spring-biased hammer 30 is released to rotate clockwise through a slot 32 of a bolt carrier 34 (FIG. 3) and eventually strike a firing pin 36 for firing cartridge 24. The firing of cartridge 24 causes the bullet to travel outwardly through the bore of the barrel 20 under the impetus of the expanding gases. Some of these gases are diverted through a gas port (not shown) and ultimately reach a passage 38 in the bolt carrier 34, whereupon automatic recoil of the bolt carrier 34, and subsequently a bolt 40 carried thereby, occurs. The automatic recoil of the bolt and carrier assembly 15 results in ejection of the spent cartridge and subsequent chambering of a new cartridge 24 positioned in a magazine 42.

The construction of the means for providing the automatic recoil are depicted and described in U.S. Pat. No. 2,951,424, issued to E. M. Stoner on Sept. 6, 1960. As more fully set forth in the Stoner patent, a chamber 44, defined by a flange on the bolt 40 and the bolt carrier 34, fills with high pressure exhaust gas upon the firing of a cartridge 24, thereby driving the bolt carrier 34 rearwardly within chamber 14 against the bias of an operating spring 46. This action initially causes an annular shoulder 48 of the bolt carrier 34 to contact the flange 50 of the firing pin 36 while simultaneously, by virtue of the lost motion connection between the bolt carrier 34 and the bolt 40, causing a bolt cam pin 52 to travel in a helical slot 54 cut in the bolt carrier 34. Movement of the bolt cam pin within the helical slot 54 produces rotation of the bolt 40 with respect to the nonrotating bolt carrier 34, the latter being held against rotation by the engagement of a carrier key 56 on the bolt carrier 34 and a longitudinal groove 58 in the receiver 12. Rotation of the bolt 40 results in the registry of lugs 60, fashioned on the end of the bolt 40, and the slots between the inwardly extending lugs 62 on the breech end of the barrel 20, thereby permitting rearward movement of the entire bolt assembly 15 upon continuing recoil of the bolt carrier 34. The rearward momentum of the bolt and carrier assembly 15 is absorbed by the operating spring 46 which, upon dissipation of the rearward momentum of the bolt carrier 34(FIG. 2), forces the bolt and carrier assembly 15 to return to the battery position of FIG. 1. During the recoiling operation, the spent cartridge 24 is ejected and on the forward return stroke a new cartridge 24 is stripped from the magazine 42 by the bolt 40 and thereafter chambered. Of course, during the latter part of the return stroke, the bolt lugs 60 pass through the slots between the lugs 62, whereupon the bolt 40 is rotated to the locked battery position by the sliding contact between the walls of the slot 54 and the cam pin 52.

According to the present invention, the recoil assembly includes the previously mentioned operating spring 46 and a buffer, generally designated 64, mounted for axial sliding movement in forward and rearward directions within the receiver extension 16 in such a manner that it is adapted to compress the operating spring 46 during rearward movement and be propelled by the operating spring during forward movement from recoil position to battery position. It should be noted that the buffer 64 is somewhat similar in exterior physical appearance to the buffer shown in the previously mentioned patent. The buffer 64 is shown in battery position in FIG. 1, recoil position in FIG. 2, and shown approaching the battery position after recoil in FIG. 3.

Figure 3:
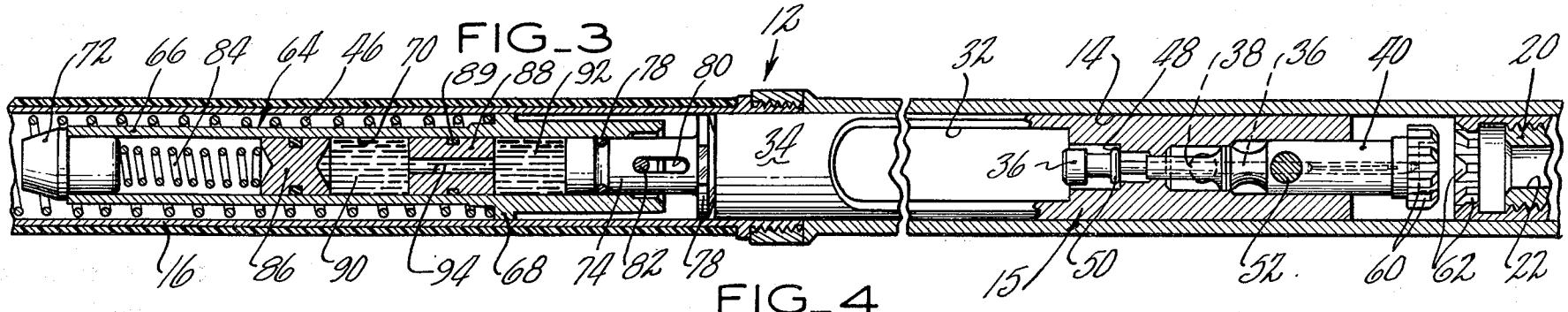
FIG. 3 is a top plan sectional view showing the components of the recoil assembly and the bolt and carrier assembly as battery position is approached after recoil.

With particular reference to FIG. 3, buffer 64 comprises a generally tubular housing 66 having an exterior annular guide flange 68 which serves as a seat for the coaxially positioned operating spring 46, in addition to guiding the reciprocating movement of the buffer 64. Within the housing 66, a cylindrical cavity 70 extends from the rear end to a location adjacent to the front thereof. Disposed within the rear end of the cavity 70 is a plug 72 which primarily functions as a dust seal and spring retainer but also acts as a bumper to further minimize shock waves and vibrations when the buffer contacts the end of the receiver extension 16 at recoil position. The plug 72 is press fitted in the cavity 70 and may be made of polyurethane of high durometer hardness. At the front end of the cavity 70 is a slideably mounted piston 74 having an enlarged diameter circular front portion or head 76, the periphery of which slides along the wall of the receiver extension 16 as does the periphery of the flange 68. The respective peripheries of the flange 68 and the enlarged diameter portion 76 of the piston 74 are each provided with three circumferentially spaced flats to minimize air pressurization within the receiver extension 16 during recoil. As depicted in FIG. 3, the piston 74 has an annular groove which receives an O-ring 78 and a longitudinal slot 80 extending transversely therethrough for receiving a forward travel limiting pin 82 fixedly secured in aligned holes in housing 66. The cavity 70 is of a greater diameter at the front end in order to provide clearance for the fillet under the head 76 of the piston 74 and prevent cutting of the O-ring 78 by the edges of the holes in which the pin 82 is mounted. A compression spring 84, seated against the bumper 72 urges a sliding seal 86 having a peripheral O-ring forwardly within the cavity 70. Interposed between the seal 86 and the rear face of piston 74 is a cylinder 88 brazed at 89 to the wall of the cavity 70 so as to define variable volume chambers 90 and 92. The cylinder 88 embodies an orifice or passage 94 for restricting the flow of hydraulic fluid (preferably MIL-H-5606) which fills the volume between the piston 74 and the sliding seal 86.

When the piston 74 is moved inwardly toward the depressed position, with respect to the housing 66, hydraulic fluid flows from chamber 92 to chamber 90 via the orifice 94. The volume of chamber 92 is consequently decreased, whereas the volume of chamber 90 is increased due to the rearward sliding of the seal 86 against the bias of the spring 84. Releasing the inward force on the piston 74, results the seal pushing hydraulic fluid (under the urging of spring 84) through the orifice 94 from the chamber 90 to the chamber 92. Hence, the piston 74 is in essence spring biased toward the extended position. Of course, during the extension of the piston 74, the volume of chamber 90 decreases while the volume of chamber 92 increases.

OPERATION

In automatic operation of the firearm, the recoil assembly operates as follows: Trigger 34 is pulled to allow the hammer 30 to strike the firing pin 36 to fire a cartridge 24 chambered in the barrel 20. The expanding gases impel the bolt carrier 34, and subsequently the bolt 40, rearwardly from the battery position.

Figure 2:
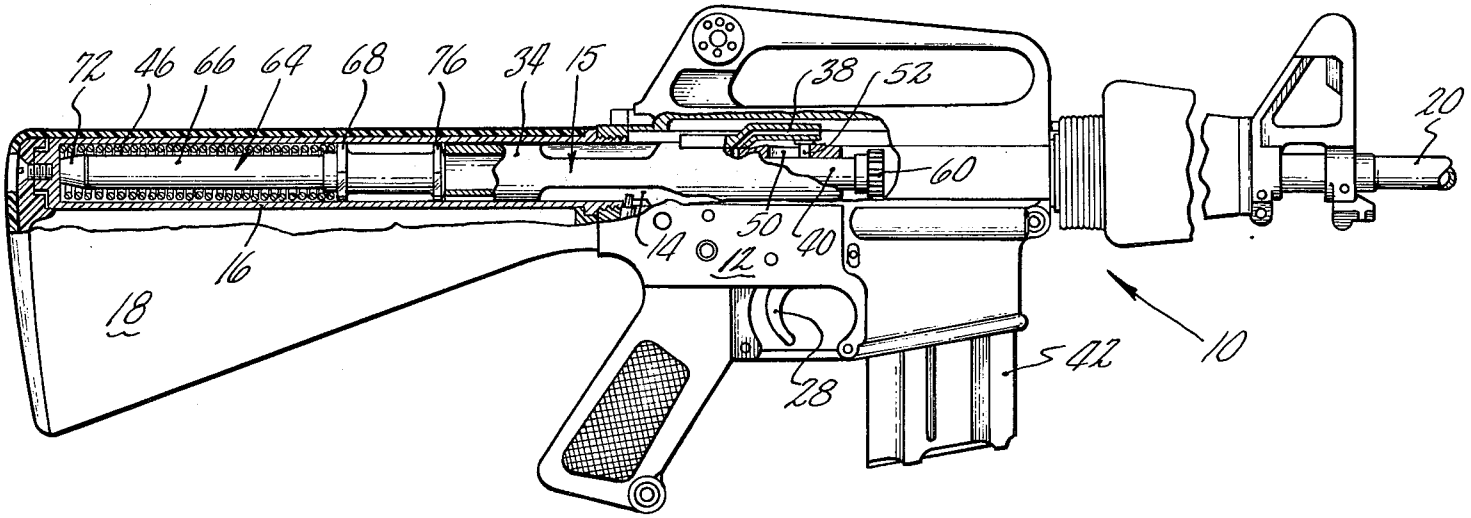
FIG. 2 is a side elevational view similar to that of FIG. 1, with the components thereof in the recoil position.

The piston 74, which was originally fully extended with the left wall of the slot 80 in contact with the pin 82, initially moves a small distance relative to the housing 66 toward the retracted position as the bolt carrier 34 begins its rearward movement. During further recoil, the bolt and carrier assembly 15 and the buffer 64 travel in unison toward the recoil position against the bias of spring 46 while the piston 74 moves forwardly back to extended position. It should be noted that the spring 84 must be sufficiently stronger than the operating spring 46 to prevent depression of the piston 74 during this further recoil until the bumper 72 contacts the end wall of the receiver extension 16. At the end of the recoil stroke bumper 72 bottoms against the end wall of the receiver extension 16. The bolt and carrier assembly 15 continues its movement toward its recoil position by moving piston 74 from the extended to the retracted position. In FIG. 2, the bolt carrier 34 has attained the recoil position wherein the piston 74 is fully depressed with its head in contact with housing 66 and the right wall of slot 80 spaced from the pin 82. Next, the operating spring 46 drives the buffer 64, and hence the bolt carrier 34, forwardly toward the battery position. During this return stroke, the piston 74 moves from the retracted position to the extended position as the sliding seal 86 pushes fluid through the orifice 94. Before the bolt carrier 34 hits the breech end of the barrel 20, piston 74 assumes the fully extended position. The piston 74, which, of course, is always in contact with the rear end of the bolt carrier 34, stops with the bolt carrier 34 as the latter hits the breech end of the barrel 20. However, the inertia of the other parts of the buffer 64 will minimize bounce of the bolt carrier 34 as the fluid pressure on the rear of the piston 74 momentarily increases. In this regard, the extent of travel of the housing 66 over the piston 74 is very small. The housing 66 then returns rearwardly such that the piston 74 is fully extended prior to the next cycle.

Figure 4:
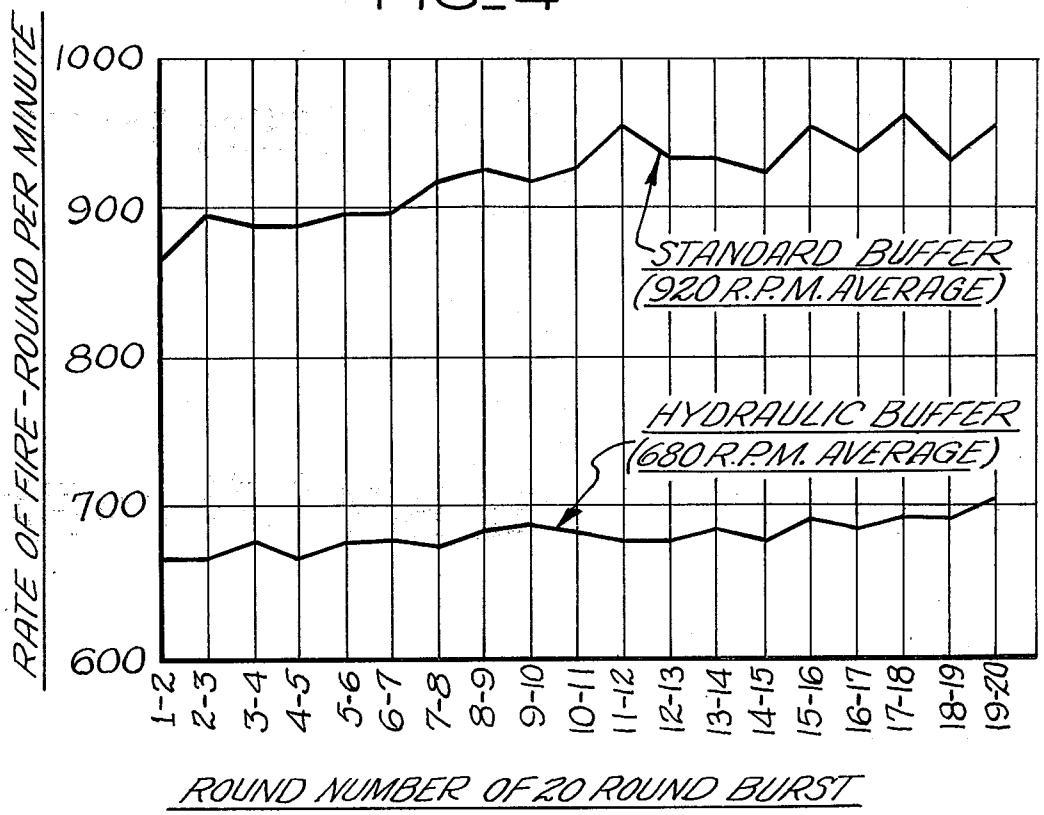
FIG. 4 is a graph comparing the round to round rate of fire of a 20 round burst for automatic firearms incorporating a conventional recoil assembly and a recoil assembly of the invention.

As illustrated in the graph of FIG. 4, which was derived from actual test results, a buffer of the invention achieves a rate of fire reduction of about 240 rounds per minute (RPM) over that of a buffer as shown in U.S. Pat. No. 3,366,011 while reducing the rate of fire variation between rounds, thereby to smooth out the operation of the firearm.

Obviously many variations and modifications are possible in light of the above teachings without departing from the scope or spirit of the invention, as set forth in the subjoined claims. For example, the invention is applicable to a blowback operated weapon, such as a submachine gun, wherein the bolt and carrier assembly is constituted by a single mass of material. In addition, the orifice of the buffer could be constituted by a wall in the cavity and a passage in, or exteriorly of, the housing.

What is claimed is:

1. An improved semiautomatic or automatic firearm of the type having a receiver with a longitudinal chamber, a bolt and carrier assembly mounted in the chamber for reciprocating movement between recoil and battery positions, a buffer, having a cavity means, mounted in the chamber in contact with the bolt and carrier assembly for movement therewith, spring means to urge the buffer into contact with the bolt and carrier assembly for biasing the bolt and carrier assembly toward the battery position, and wherein the improvement comprises:

a piston mounted in the cavity means for reciprocating movement between extended and depressed positions, the piston being in contact with the bolt and carrier assembly;

a sliding seal movably mounted within the cavity means;

orifice means operatively interposed between the piston and the seal to establish first and second variable volume chambers in the cavity means respectively adjacent to the seal and the piston in restricted fluid communication;

hydraulic fluid filling the first and second variable volume chambers when the piston is in extended and depressed positions such that depression of the piston reduces the volume of the second variable volume chamber and increases the volume of the first variable volume chamber by pushing the fluid through the orifice means and such that subsequent movement of the seal toward the piston decreases the volume of the first variable volume chamber and increases the volume of the second variable volume chamber by pushing the fluid through the orifice means; and means to bias the seal toward the piston so as to exert a fluid pressure on the piston which urges the piston to the extended position.

2. The improvement of claim 1 wherein the buffer is of the type having a bumper mounted thereupon for engaging the wall of the longitudinal chamber in the recoil position of the bolt and carrier assembly for minimizing shock and wherein the bias means comprises:

a spring in the cavity means seated against the bumper and the seal.

3. The improvement of claim 1 wherein the bolt and carrier assembly is of the type which comprises a bolt carrier and a bolt mounted thereupon such that a limited lost motion connection exists therebetween.

* * * * *

UNITED STATES PATENT OFFICE

CERTIFICATE OF CORRECTION

Patent No. 3,977,296 Dated August 31, 1976

Inventor(s) Stanley D. Silsby et al.

It is certified that error appears in the above-identified patent and that said Letters Patent are hereby corrected as shown below:

Correct the name of the Assignee from "Colt Industries Operating Corporation (Firearms Division), Hartford, Conn." to -- Colt Industries Operating Corp (Firearms Division), Hartford, Conn. -- .

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*